US010352330B2

(12) United States Patent
Cellier

(10) Patent No.: US 10,352,330 B2
(45) Date of Patent: Jul. 16, 2019

(54) TURBOMACHINE PART WITH A NON-AXISYMMETRIC SURFACE

(71) Applicant: SAFRAN AIRCRAFT ENGINES, Paris (FR)

(72) Inventor: Damien Joseph Cellier, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 456 days.

(21) Appl. No.: 15/028,059

(22) PCT Filed: Oct. 10, 2014

(86) PCT No.: PCT/FR2014/052586

§ 371 (c)(1),
(2) Date: Apr. 8, 2016

(87) PCT Pub. No.: WO2015/052455

PCT Pub. Date: Apr. 16, 2015

(65) Prior Publication Data

US 2016/0245299 A1 Aug. 25, 2016

(30) Foreign Application Priority Data

Oct. 11, 2013 (FR) ..... 13 59895

(51) Int. Cl.
*F01D 5/14* (2006.01)
*F04D 29/32* (2006.01)
(Continued)

(52) U.S. Cl.
CPC ..... *F04D 29/322* (2013.01); *F01D 5/143* (2013.01); *F04D 29/321* (2013.01);
(Continued)

(58) Field of Classification Search
CPC ..... F01D 5/143; F04D 29/321; F04D 29/322; F04D 29/324; F04D 29/329;
(Continued)

(56) References Cited

U.S. PATENT DOCUMENTS 7,354,243 B2 * 4/2008 Harvey ..... F01D 5/143 415/191
7,465,155 B2 * 12/2008 Nguyen ..... F01D 5/143 415/191
(Continued)

FOREIGN PATENT DOCUMENTS

EP 1 762 700 A2 3/2007
EP 2 597 257 A1 5/2013
(Continued)

OTHER PUBLICATIONS

International Search Report and Written Opinion dated Mar. 24, 2015 in PCT/FR2014/052586 filed Oct. 10, 2014 (with English language translation).
(Continued)

*Primary Examiner* — Igor Kershteyn
*Assistant Examiner* — Christopher R Legendre
(74) *Attorney, Agent, or Firm* — Oblon, McClelland, Maier & Neustadt, L.L.P.

(57) ABSTRACT

A turbomachine part including at least first and second blades, and a platform from which the blades extend, wherein the platform has a non-axisymmetric surface limited by first and second end planes, and defined by at least three construction curves of class CI each representing the value of a radius of the surface on the basis of a position between the lower surface of the first blade and the upper surface of the second blade according to a plane substantially parallel to the end planes, including a first curve that increases in the vicinity of the second blade; a second curve
(Continued)

that decreases in the vicinity of the second blade; a third curve having a minimum at the second blade.

13 Claims, 8 Drawing Sheets

(51) Int. Cl.
*F04D 29/52* (2006.01)
*F04D 29/54* (2006.01)
*F04D 29/68* (2006.01)

(52) U.S. Cl.
CPC ..... *F04D 29/324* (2013.01); *F04D 29/329* (2013.01); *F04D 29/522* (2013.01); *F04D 29/542* (2013.01); *F04D 29/544* (2013.01); *F04D 29/681* (2013.01); *F05B 2240/80* (2013.01); *F05B 2250/71* (2013.01); *F05D 2220/30* (2013.01); *F05D 2230/50* (2013.01); *F05D 2240/80* (2013.01); *F05D 2250/71* (2013.01)

(58) Field of Classification Search
CPC .... F04D 29/542; F04D 29/544; F04D 29/681; F05B 2240/80; F05B 2250/71; F05D 2240/80; F05D 2270/71
See application file for complete search history.

(56) References Cited

U.S. PATENT DOCUMENTS

| | | | | |
|---|---|---|---|---|
| 9,200,638 | B2 * | 12/2015 | Boston | F01D 5/143 |
| 9,316,103 | B2 * | 4/2016 | Passrucker | F01D 5/145 |
| 9,458,720 | B2 * | 10/2016 | Cellier | F01D 5/143 |
| 2007/0059177 | A1 | 3/2007 | Harvey | |
| 2011/0044818 | A1 | 2/2011 | Kuhne et al. | |
| 2012/0201692 | A1 | 8/2012 | Boston et al. | |
| 2013/0136619 | A1 | 5/2013 | Passrucker et al. | |
| 2013/0315738 | A1 | 11/2013 | Cellier et al. | |
| 2016/0245299 | A1 * | 8/2016 | Cellier | F01D 5/143 |

FOREIGN PATENT DOCUMENTS

| | | | |
|---|---|---|---|
| WO | WO 2011/039352 | A2 | 4/2011 |
| WO | WO 2012/107677 | A1 | 8/2012 |

OTHER PUBLICATIONS

French Preliminary Search Report and Written Opinion dated Jun. 24, 2014 in Patent Application No. 1359895 (with English translation of categories of cited documents).

* cited by examiner

TURBOMACHINE PART WITH A NON-AXISYMMETRIC SURFACE

GENERAL TECHNICAL FIELD

The invention relates to a part of a turbine engine comprising blades and a platform having a non-axisymmetrical surface.

STATE OF THE ART

Figure 1A:
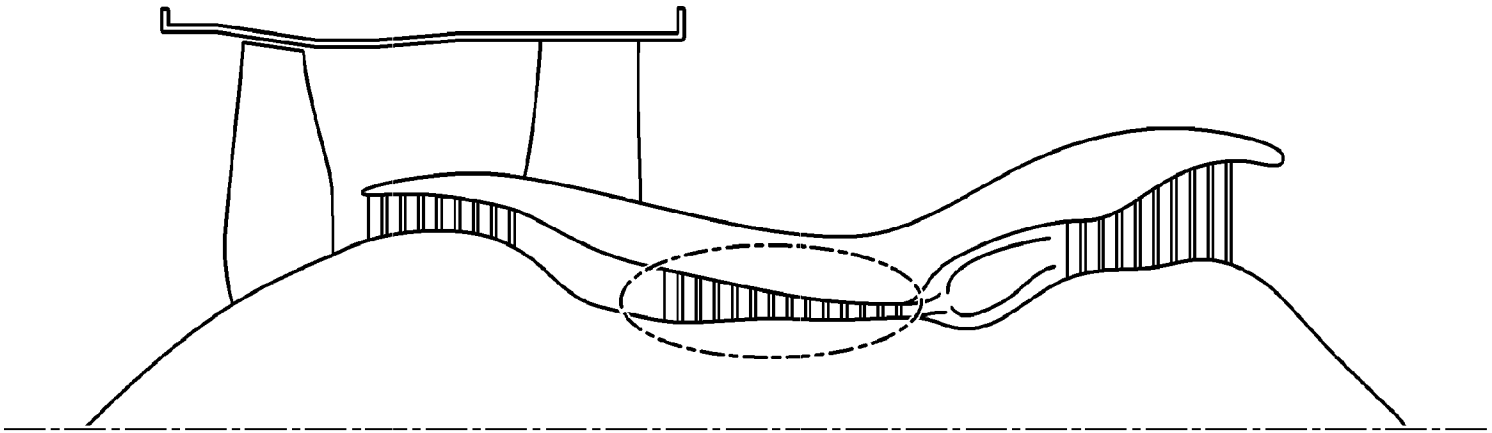

The necessity for constant improvement if performance of equipment, aeronautical in particular, for example rotors of turbine engines (i.e., the assembly formed with a hub on which vanes (or blades) radially extending are fixed, as seen in FIG. 1*a*) today requires the use of computer modelling tools.

These tools aid in designing parts by optimising automatedly some of their characteristics by executing a large number of simulation computations.

Figure 1B:
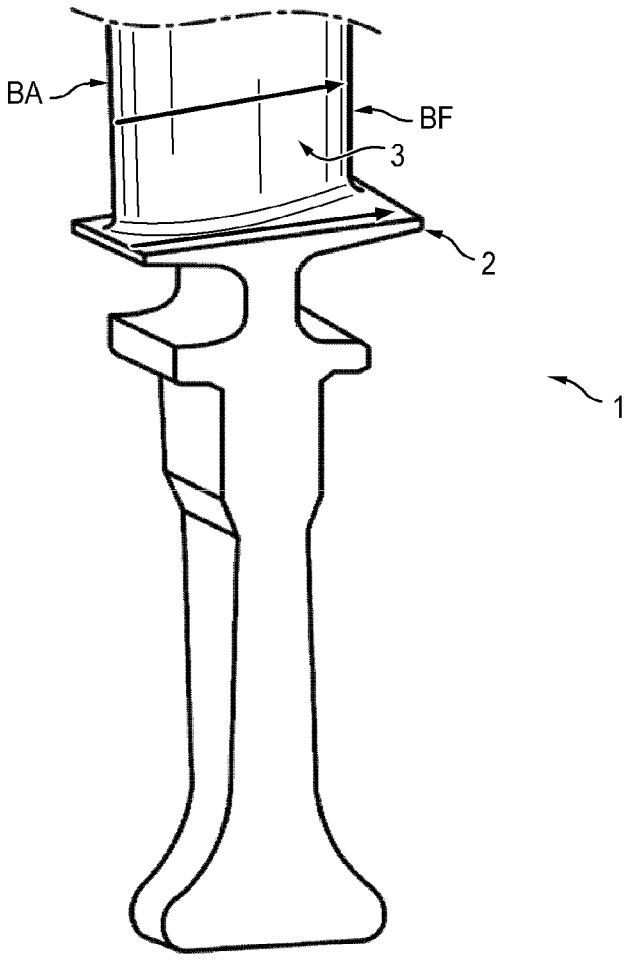

International application WO 2012/107677 discloses for instance blade/platform assemblies (in others words the assembly formed by a blade and the local surface of the hub or casing on which the blade is fixed, such as shown for example by FIG. 1*b*) optimised by "contouring" (i.e., by definition of hollows and bosses in the wall) offering excellent performance in supersonic flow. The platform especially has a circumferential depression axially extending between the leading edge and the trailing edge of the blade.

Yet, it is evident that these axisymmetrical geometries can still be refined, in particular at the compressor stages of the turbine engine: the search for aeromechanical geometrical optimum on the rotors/stators in fact these days results in the production of parts having a locally non-axisymmetrical wall (i.e., that a section according to a plane perpendicular to the axis of rotation is not circular) at the vein, i.e., all the ducts between the vanes for the flow of fluid (in other words the inter-vane sections), in light of the particular prevalent conditions. The non-axisymmetrical vein defines an overall annular surface of a three-dimensional space (a "tranche" of the turbine engine).

Also, even though the non-axisymmetrical geometries prove promising, their handling is complex.

It would be preferable to use them to improve performance in terms of yield of equipment but without degrading either operability or mechanical strength.

PRESENTATION OF THE INVENTION

According to a first aspect, the present invention proposes a part of a turbine engine comprising at least first and second blades, and a platform from which the blades extend, characterized in that the platform has a non-axisymmetrical surface limited by a first and a second end plane, and defined by at least three construction curves of class $C^1$ each representing the value of a radius of said surface as a function of a position between the intrados of the first blade and the extrados of the second blade according to a plane substantially parallel to the end planes, whereof:

- a first curve increasing in the vicinity of the second blade;
- a second curve arranged between the first curve and a trailing edge of the first and second blades, and decreasing in the vicinity of the second blade;
- a third curve arranged between the first curve and a leading edge of the first and second blades, and having a minimum at the first blade.

This particular non-axisymmetrical geometry of the surface of the part offers control of the uneven fluid flow, hence increasing yield.

The mechanical strength is not degraded as such.

According to other advantageous and non-limiting characteristics:

- the third curve is strictly increasing between the intrados of the first blade and the extrados of the second blade;
- the third curve is less than the first curve in the vicinity of the second blade;
- the first curve is strictly increasing between the intrados of the first blade and the extrados of the second blade;
- the second curve has a local maximum between the intrados of the first blade and the extrados of the second blade
- each construction curve is also defined by a position along a blade chord extending from the leading edge to the trailing edge of the blade;
- the first curve is associated to a position located between 0% and 60% of relative length of blade chord, and the second curve is associated to a position located between 65% and 100% of relative length of blade chord;
- the third curve is associated to a position located between 0% and 25% of relative length of blade chord, and the first curve is associated to a position located between 30% and 60% of relative length of blade chord;
- the platform has an annular form along which a plurality of blades is uniformly arranged;
- the platform has the same non-axisymmetrical surface between each pair of consecutive blades;
- the part is a rotor or stator stage of the compressor;
- each construction curve has been modelled by performing steps of data-processing means:
  - (a) Parametrization of the construction curve as curve of class $C^1$ representing the value of the radius of said surface as a function of a position between the intrados of the first blade and the extrados of the second blade, the curve being defined by:
    - Two end control points, respectively on each of the two blades between which said surface extends;
    - At least one spline;
    - parametrization being carried out according to one or several parameters defining at least one of the end control points;
  - (b) Determination of optimised values of said parameters of said curve.

According to a second aspect, the invention relates to a turbine engine comprising a part according to the first aspect.

PRESENTATION OF FIGURES

Figure 1C:
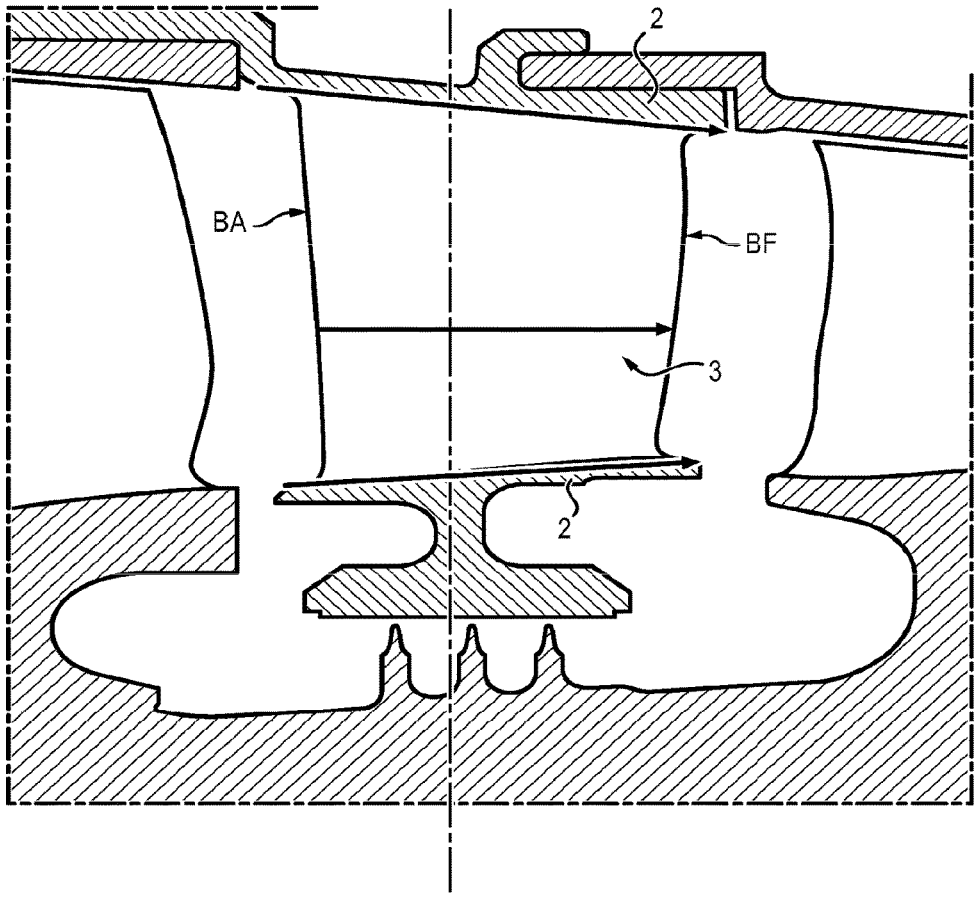
Figure 2:
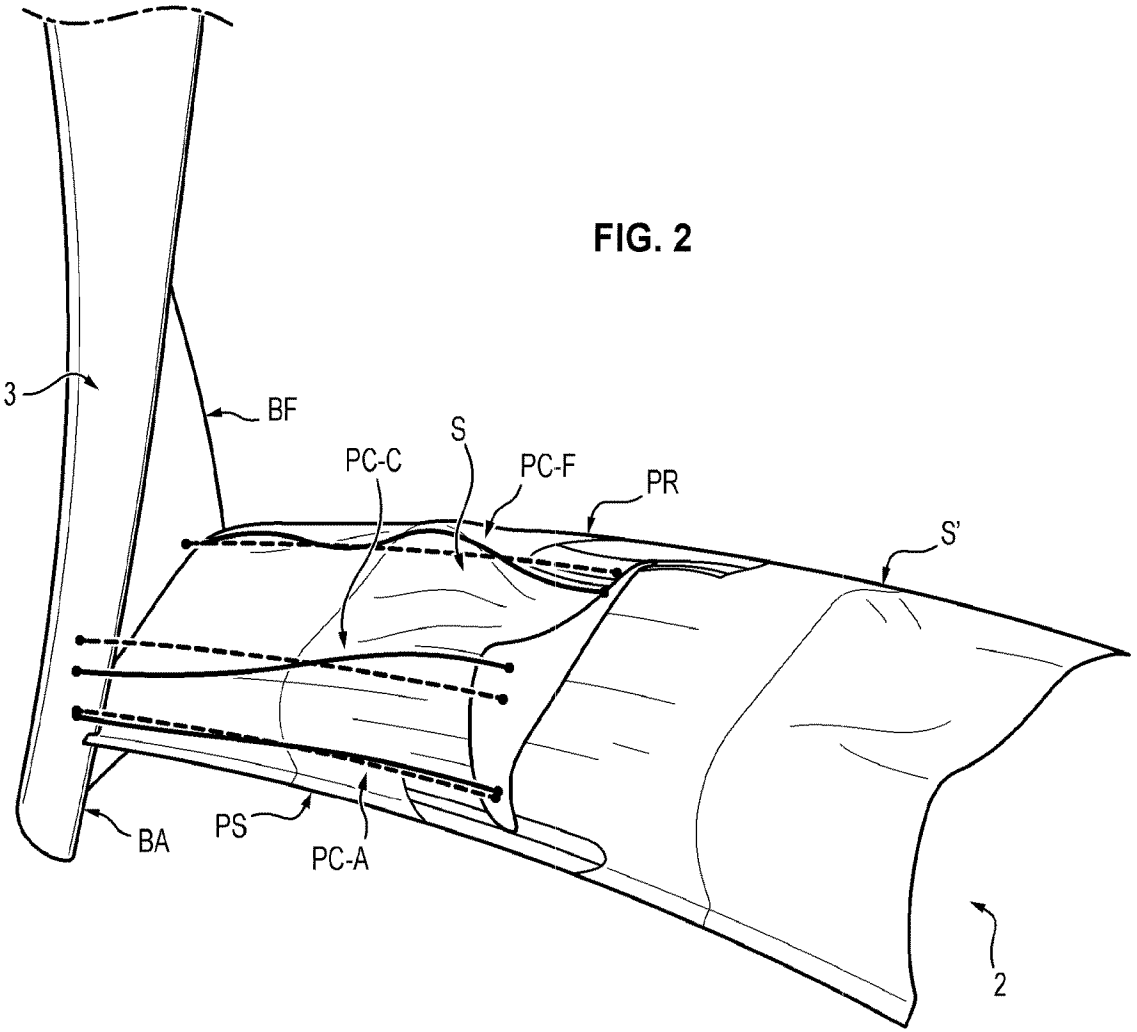
Figure 3A:
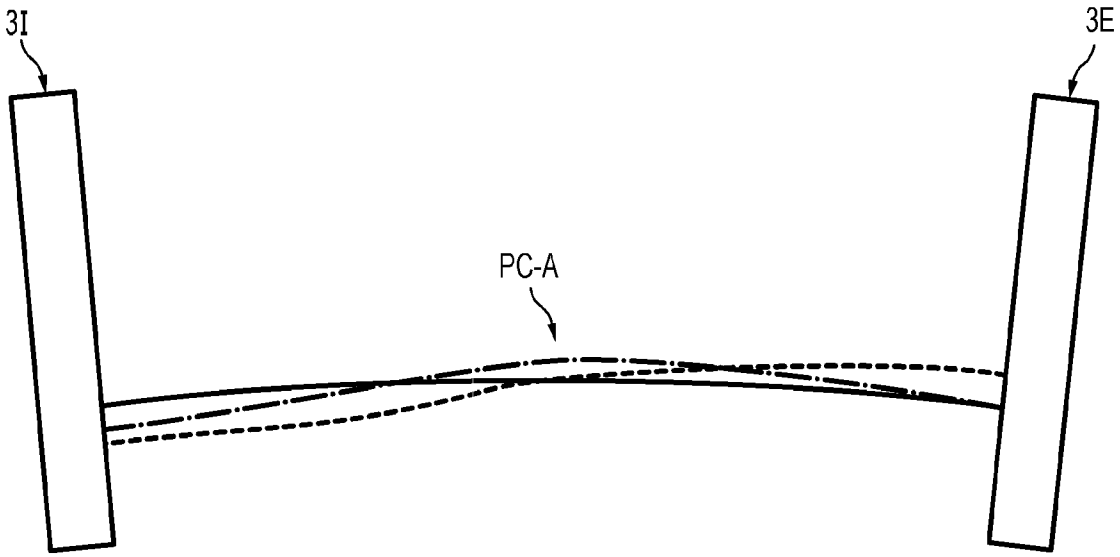
Figure 3B:
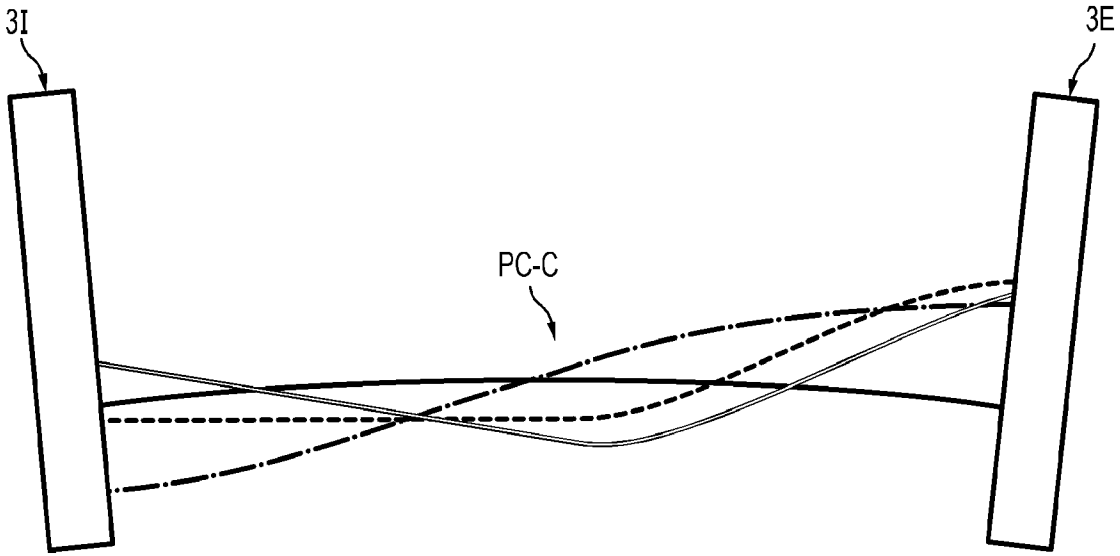
Figure 3C:
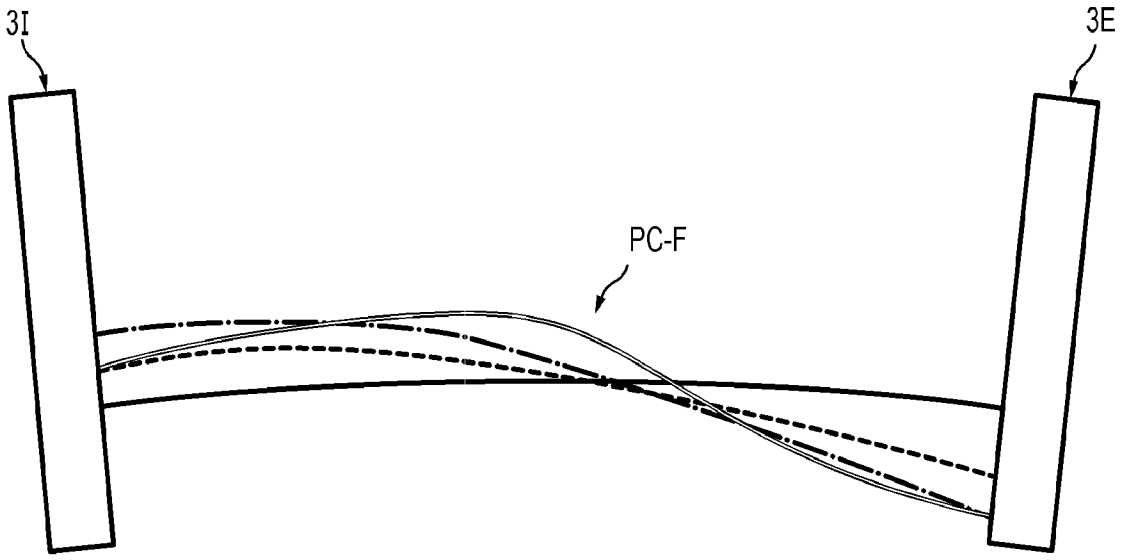
Figure 3D:
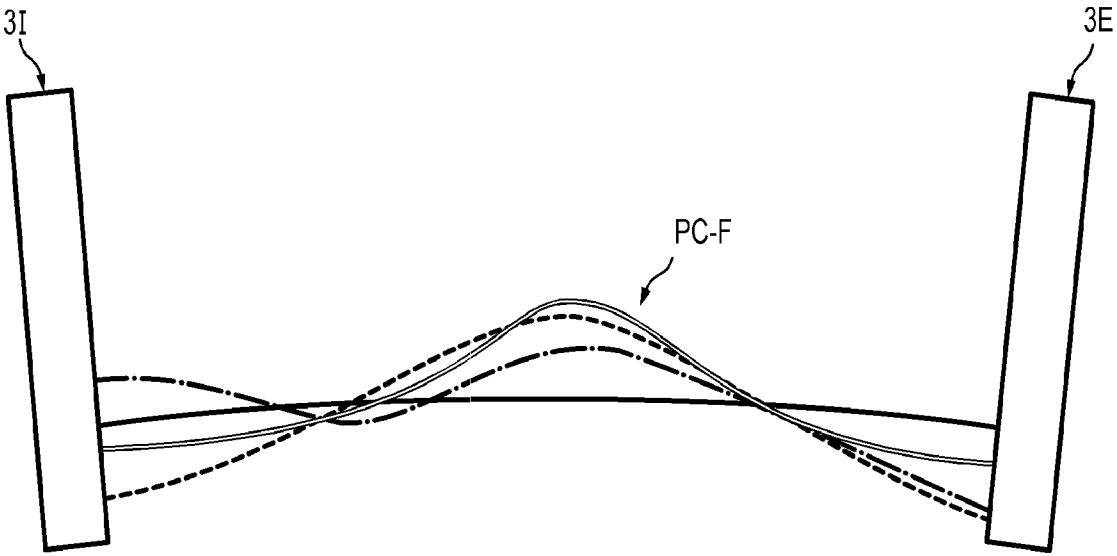

Other characteristics and advantages of the present invention will emerge from the following description of a preferred embodiment. This description will be given in reference to the appended drawings, in which:

FIG. 1*a* previously described illustrates an example of a turbine engine;

FIGS. 1*b*-1*c* illustrate two examples of platform/blade assemblies;

FIG. 2 illustrates an architecture of a part according to the invention;

FIG. 3*a* illustrates examples of geometries of a third construction curve of a surface of a platform of a part according to the invention;

FIG. 3*b* illustrates examples of geometries of a first construction curve of a surface of a platform of a part according to the invention; and FIGS. 3*c*-3*d* illustrate examples of geometries of a second construction curve of a surface of a platform of a part according to the invention.

DETAILED DESCRIPTION

The present invention relates to a part of a turbine engine 1, in particular a compressor part, having at least two blades 3 and a platform 2 from which the blades 3 extend. The term platform is here interpreted in the wide sense and in general designates any element of a turbine engine on which blades 3 can be mounted (by extending radially) and having an internal/external wall against which air circulates.

In particular, the platform 2 can be single block (and support all the blades of the part 1), or formed by a plurality of elementary elements each supporting a single blade 3 (a "root" of the blade 3) so as to constitute a vane of the type of that shown in FIG. 1*b*.

Furthermore, the platform 2 can delimit a radially internal wall of the part 1 (gas passes around) by defining a hub, and/or else a radially external wall of the part 1 (gas passes inside, the blades 3 extend to the centre) by defining a casing of the part 1. It should be noted that the same part 1 can comprise these two types of platform 2 at the same time (see FIG. 1*c*).

It is understood that the part 1 can be many types, especially a rotor stage (blisk (bladed disk), or impeller, according to the integral character or not of the assembly) or stator stage (having fixed or moveable vanes VSV (variable stator vane)), in particular at a compressor, and especially the high-pressure compressor (HPC), see FIG. 1*a* already introduced.

Throughout the present description the example of a HPC blisk will be used in this way, but those skilled in the art can transpose to other types of parts 1.

Platform Surface

The present part 1 is distinguished by a particular (non-axisymmetrical) geometry of a surface S of a platform 2 of the part 1, an advantageous modelling example is seen in FIG. 2.

The surface S extends between two blades 3 (one of which is not shown in FIG. 2 to better show the surface S, but a hole is seen at its placement) which limit it laterally.

The surface S is in fact a portion of a larger surface defining a substantially toric form about the part 1, which here is explained as a rotor stage. In the advantageous (but non-limiting) hypothesis of periodicity in the circumference of the part 1 (i.e., if the blades 3 are identical and distributed uniformly), the wall is constituted by a plurality of identical surfaces duplicated between each couple of blades 3.

The surface S' also evident in FIG. 2 is thus a duplication of the surface S.

Still in this figure, a line sharing each of the surfaces S and S' is visible in two halves. This structure corresponds to an embodiment in which the platform 2 consists of a plurality of elementary elements, each being a root supporting a blade 3 with which it forms a vane. Each of these blade roots extends on either side of the blade 3, hence the surface S comprises juxtaposed surfaces associated with two separate blade roots. The part 1 is an assembly of at least two juxtaposed vanes (blade/blade root assembly).

The surface S is limited upstream by a first end plane, the "separation plane" PS and downstream by a second end plane, the "connecting plane" PR, each defining an axisymmetrical, continuous contour and of continuous derivative (the curve corresponding to the intersection between each of the planes PR and PS and the surface of the part 1 in its entirety is closed and forms a loop). The surface S has a substantially rectangular form and extends continuously between the two end planes PS, PR, and the two blades 3 of a couple of consecutive blades. One of the blades of this couple of blades is the first blade 3I. It has in fact its intrados at the surface S. The other blade is the second blade 3E. It has in fact its intrados at the surface S. Each "second blade" 3E is the "first blade" 3I of an adjoining surface such as the surface S' in FIG. 2 (since each blade 3 has an intrados and an extrados).

The surface S is defined by construction curves, also called "construction planes". At least three construction curves PC-A, PC-C and PC-F are necessary to obtain the geometry of the present surface S.

In all cases, each construction curve is a curve of class $C^1$ representing the value of a radius of said surface S as a function of a position between the intrados of the first blade 3I and the extrados of the second blade 3E according to a plane substantially parallel to the end planes PS, PR.

Radius means the distance between a point of the surface and the axis of the part 1. An axisym metrical surface therefore has a constant radius.

Construction Curves

The three curves extend on substantially parallel planes. The first curve PC-C is a "central" curve. The second curve PC-F is a "trailing" curve as it is arranged near the trailing edge BF of the blades 3 between which it extends. The third curve PC-A is a "leading" curve as it is arranged near the leading edge BA of the blades 3 between which it extends.

In others words, fluid flowing in the vein successively meets the third curve PC-A, the first curve PC-C and the second curve PC-F. Their positions are not fixed, but by way of advantage each construction curve PC-A, PC-C, PC-F is also defined by a position along a blade chord 3 extending from the leading edge BA to the trailing edge BF of the blade 3.

Such a chord is shown in FIGS. 1*b* and 1*c* (as well as platform chords 2).

And in such a reference, the third curve PC-A is associated to a position located between 0% and 25% in relative length of blade chord 3, the first curve PC-C is associated to a position located between 30% and 60% of relative length of blade chord 3, and the second curve PC-F is associated to a position located between 65% and 100% of relative length of blade chord 3.

As is still seen in FIG. 2, each curve PC-A, PC-C and PC-F has a specific geometry. The aerodynamic effects of these geometries will be seen later.

FIGS. 3*a* to 3*d* represent a plurality of examples of each of these curves PC-A, PC-C and PC-F, compared to an axisymmetrical reference (constant radius).

As is seen in FIG. 3*a*, the third curve PC-A has an (overall) minimum at the first blade 3I (consequently it increases in the vicinity of the first blade 3I). In others words, the section of passage is increased at the intrados. The curve can be strictly increasing over the entire width of the surface S, or be increasing then decreasing and form a boss. In all cases, such a boss is such that the third curve PC-A is higher at the second blade 3E than at the first blade 3I (due to the minimum at the first blade 3I), and if preferred the third curve PC-A has an (overall) maximum at the second blade 3E (consequently, it is increasing in the vicinity of the second blade 3E). Relative to the known non-axisymmetrical geometries which generally propose a "valley" when entering the vein, i.e., a curve decreasing then increasing, the present geometry facilitates bypass of the leading edge BA of the second blade 3I by local convergence, since the section of vein is maximal in the intrados portion. A third curve PC-A strictly increasing is preferred as such a profile is exempt from bosses which could impair migration of the fluid entering the vein.

It is clear that this curve PC-A is not limited to a profile in particular on its extrados portion (it matters only that it is at least increasing over an interval limited by the first blade 3I and that its lowest point is at this intrados blade 3I), even if an increasing profile in the assembly is preferred.

FIG. 3*b* illustrates the first curve PC-C, which is increasing in the vicinity of the second blade 3E, meaning a reduction of the section of passage at the extrados. As for the first curve PC-A, it can be strictly increasing over the entire width of the surface S, or be decreasing then increasing and form a hollow. This curve PC-C is not limited to a profile in particular on its intrados portion (it matters only that it is at least increasing over an interval limited by the second blade 3E).

It is also preferable for the third curve PC-A to be less than the first curve PC-C in the vicinity of the second blade 3E. In others words, the amplitude of the third curve PC-A (relative to the axisymmetrical reference) is less than that of the first curve PC-C. This again causes better bypass of the second blade 3E by overconvergence.

FIGS. 3*c* and 3*d* illustrate two possible categories of geometries for the second curve PC-F. In all cases, the second curve must be decreasing in the vicinity of the second blade 3E so as to increase the section of passage at the extrados.

It is preferable that the section of passage at the intrados is reduced, in others words at the first blade 3I the first curve PC-C is less than the second curve PC-F. This allows better control of the migration of fluid by overconvergence to the intrados. This can be as evident in FIG. 3*c* due to the curve being strictly decreasing (or almost), or alternatively via a boss. In FIG. 3*d*, the second curve PC-F has a local maximum between the intrados of the first blade 3I and the extrados of the second blade 3E. This maximum is located around the central portion of the curve. As is particularly preferred the second curve PC-F is decreasing, then increasing (as far as the boss) and finally decreasing. Such a structure with central boss allows a ramp phenomenon (see below) limiting migration of fluid from the intrados to the extrados (i.e. from the first blade 3I to the second blade 3E).

The particularly preferred geometries are shown in FIG. 2.

Modelling of the Surface

The definition of the surface via the three construction curves PC-A, PC-C, PC-F facilitates automatic optimisation of the part 1.

Advantageously, each construction curve PC-A, PC-C, PC-F is modelled by performing steps of:

(a) Parametrization of the construction curve PC-A, PC-C, PC-F as curve of class $C^1$ representing the value of the radius of said surface S as a function of a position between the intrados of the first blade 3I and the extrados of the second blade 3E, the curve being defined by:

Two end control points, respectively on each of the two blades 3, 3I, 3E between which said surface S extends;

At least one spline;

the parametrization being executed according to one or several parameters defining at least one of the end control points;

(b) Determination of optimised values of said parameters of said curve.

These steps are conducted by computer equipment comprising data-processing means (for example a supercomputer).

Some parameters of the end control points, in particular the value of the derivative at this point, are fixed so as to respect the conditions on the increasing/decreasing of each curve PC-A, PC-C, PC-F such as defined earlier. Intermediary control points can also be included, for example to form a boss on the second curve PC-F.

Many criteria can be selected as criteria to be optimised during modelling of each curve. By way of example, the attempt can be made to maximise mechanical properties such as resistance to mechanical stress, frequency responses, displacements of blades 3, aerodynamic properties such as the yield, the pressure rise, the throughput capacity or pumping margin, etc.

For this it is necessary to parameterise the law to be optimised, i.e., make a function of N input parameters of it. Optimisation consists of varying (generally randomly) these different parameters under a constraint to determine their optimum values for a predetermined criterion. A "smoothed" curve is then obtained by interpolation from the determined passage points.

The number of computations necessary is directly associated (linearly or even exponentially) to the number of input parameters of the problem.

Many methods are known, but a method will preferably be used similar to that described in patent application FR1353439 which provides excellent modelling quality, without high computing power consumption and with limiting the Runge phenomenon (excessive "ripple" of the surface).

It should be noted that the blade 3 is connected to the platform 2 via a connecting curve (seen for example in FIG. 1*b*), which can form the subject of specific modelling, especially also via the use of splines and user control points.

Effect of these Geometries

The example of a surface S of a hub of the part 1 will be taken here.

On the extrados portion (in the vicinity of the second blade 3E), the surface is initially over-raised on a first portion of the chord of the blade, then lowered on a second portion.

This creates stronger convergence (than for example with geometries of "valley" type) on the first portion of the blade 3E, making fluid deviation easier locally. There is no overall closing of section, or overall acceleration of fluid and no rise in losses by shock.

At the second portion (over-lowered), a 3D effect associated to the rise of the intrados-side wall (or any boss in the middle of the duct) and to overconvergence at the intrados causes a ramp phenomenon aiding deviation and control of corner flows (rise of the flow to the extrados of the second blade 3E).

If appropriate, the boss on the second curve PC-F limits migration of fluid from the intrados to the extrados, providing even better control of corner flows coin.

Results

Relative to contouring, better flow control in the duct (better controlled secondary flows, local convergences in the key zones) enables consequent improvement in yield. Tests have shown that the gain is from 0.1 to 0.4% in complete compressor yield.

Also, the new geometry has also contributed in terms of mechanical situation, favouring the control of the blade/platform connection. Maximal stress is reduced.

The invention claimed is:

1. A part of a turbine engine, the part comprising:

at least first and second blades; and a platform from which the blades extend, wherein the platform has a non-axisymmetrical surface limited by a first and a second end plane, and defined by at least three construction curves of class $C^1$ each representing the value of a radius of said surface as a function of a position from an intrados of the first blade to an extrados of the second blade according to a plane parallel to the end planes, whereof:

a first curve increasing at the second blade;

a second curve arranged between the first curve and a trailing edge of the first and second blades, and decreasing at the second blade;

a third curve arranged between the first curve and a leading edge of the first and second blades, and having a minimum at the first blade.

2. The part according to claim 1, wherein the third curve is strictly increasing from the intrados of the first blade to the extrados of the second blade.

3. The part according to claim 1, wherein the third curve is less than the first curve at the second blade.

4. The part according to claim 1, wherein the first curve is strictly increasing from the intrados of the first blade to the extrados of the second blade.

5. The part according to claim 1, wherein the second curve has a local maximum between the intrados of the first blade and the extrados of the second blade.

6. The part according to claim 1, wherein the first curve is associated to a position along a blade chord extending from the leading edge to the trailing edge of the first and second blades located between 0% and 60% of relative length of blade chord, and the second curve is associated to a position along the blade chord located between 65% and 100% of relative length of blade chord.

7. The part according to claim 6, wherein the third curve is associated to a position along the blade chord located between 0% and 25% in relative length of blade chord, and the first curve is associated to a position along the blade chord located between 30% and 60% of relative length of blade chord.

8. The part according to claim 1, wherein the platform has an annular form along which the at least first and second blades is uniformly arranged.

9. The part according to claim 8, wherein the platform has said non-axisymmetrical surface between each consecutive pair of blades of the at least first and second blades.

10. The part according to claim 9, being a compressor part of the turbine engine.

11. The part according to claim 10, being a rotor or stator stage of the compressor.

12. The part according to claim 1, for which each construction curve is modelled by a data-processor performing steps of:

parametrization of the construction curve as curve of class $C^1$ representing the value of the radius of said surface as a function of a position between the intrados of the first blade and the extrados of the second blade, the curve being defined by:

two end control points, respectively on each of the first and second blades between which said surface extends; and at least one spline;

parametrization being performed according to at least one parameter defining at least one of the end control points;

determination of optimized values of said at least one parameter.

13. A turbine engine comprising a part according to claim 1.

* * * * *